US007950979B2

(12) United States Patent
Barthold

(10) Patent No.: US 7,950,979 B2
(45) Date of Patent: May 31, 2011

(54) TRANSFORMING VEHICLE

(75) Inventor: Mark J. Barthold, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 351 days.

(21) Appl. No.: 12/210,215

(22) Filed: Sep. 15, 2008

(65) Prior Publication Data

US 2009/0075559 A1 Mar. 19, 2009

Related U.S. Application Data

(60) Provisional application No. 60/972,799, filed on Sep. 15, 2007.

(51) Int. Cl.
*A63H 17/26* (2006.01)
*A63H 33/00* (2006.01)

(52) U.S. Cl. ..... 446/470; 446/489

(58) Field of Classification Search ..... 446/431, 446/465, 470, 489; 472/57, 71, 72, 77
See application file for complete search history.

(56) References Cited

U.S. PATENT DOCUMENTS

| | | | | | |
|---|---|---|---|---|---|
| 261,775 | A | * | 7/1882 | Smith et al. | 446/321 |
| 1,361,584 | A | * | 12/1920 | Howard | 446/460 |
| 1,699,383 | A | * | 1/1929 | Taylor | 40/491 |
| 2,198,235 | A | * | 4/1940 | Van Tongeren | 446/476 |
| 2,236,143 | A | | 3/1941 | Kellermann | |
| 2,401,937 | A | * | 6/1946 | Kingson | 446/449 |
| 2,621,098 | A | * | 12/1952 | Ford et al. | 312/204 |
| 2,749,657 | A | * | 6/1956 | Lohnes | 446/150 |
| 4,043,590 | A | * | 8/1977 | Pizzuti | 296/222 |
| 4,244,144 | A | * | 1/1981 | Goldberg et al. | 446/279 |
| 4,382,347 | A | * | 5/1983 | Murakami | 446/433 |
| 4,435,916 | A | | 3/1984 | Iwao | |
| 4,467,556 | A | | 8/1984 | Iwao | |
| 4,655,726 | A | * | 4/1987 | Brzezinski et al. | 446/268 |
| 4,717,367 | A | * | 1/1988 | Stubenfoll et al. | 446/437 |
| 4,915,633 | A | * | 4/1990 | Auer et al. | 434/159 |
| 5,112,267 | A | * | 5/1992 | Liu et al. | 446/470 |
| 5,451,181 | A | * | 9/1995 | Denoux | 446/465 |
| 5,667,421 | A | | 9/1997 | Uetake | |
| 5,810,638 | A | * | 9/1998 | Wood | 446/73 |
| 5,860,846 | A | | 1/1999 | Uetake | |
| D424,632 | S | * | 5/2000 | Hollis et al. | D21/548 |
| 6,102,771 | A | * | 8/2000 | Poznick et al. | 446/465 |

FOREIGN PATENT DOCUMENTS

JP 60-135196 U 9/1985

(Continued)

*Primary Examiner* — Gene Kim
*Assistant Examiner* — Alyssa M Hylinski
(74) *Attorney, Agent, or Firm* — The Mueller Law Offices, P.C.

(57) ABSTRACT

A toy vehicle is transformed from a first configuration to a second configuration through relative movement of two portions of the vehicle. The vehicle includes a roof panel which closes a roof area during the transition from the first configuration to the second configuration. The closing of the roof area hides the displacement of a first seat in the vehicle by a second seat. When the first seat is mounted with a first toy figure and the second seat is mounted with a different toy figure, an illusion is created that the initial toy figure has changed appearance. The roof panel may close and reopen at a rate rapid enough to render the change of toy figures to be an instantaneous transformation. Additional deployable components such as projectile launchers, tail fins, and front bumpers may be incorporated into the toy vehicle.

19 Claims, 7 Drawing Sheets

FOREIGN PATENT DOCUMENTS

| | | | |
|---|---|---|---|
| JP | 62-125592 | U | 8/1987 |
| JP | 62-177789 | U | 11/1987 |
| JP | 62-177791 | U | 11/1987 |
| KR | 20-1994024287 | U | 11/1994 |

* cited by examiner

TRANSFORMING VEHICLE

RELATED APPLICATIONS

This application claims priority to U.S. Provisional Patent Application Ser. No. 60/972,799 filed on Sep. 15, 2007 entitled "Transforming Vehicle," which is hereby incorporated by reference as if set forth in full in this application for all purposes.

BACKGROUND OF THE INVENTION

Toy vehicles are common items used by young people during play. While the variety of shapes of such toy vehicles is virtually limitless, these vehicles are more interesting if they resemble vehicles exciting to children such as sports cars or fantasy cars. Such toy vehicles may be even more engaging if they can be made to change shape and thereby provide further novelty and role play.

In one category of toy vehicles known in the art, toy vehicles have been configured with front and rear halves which may slide apart from each other. As the two halves are manually pulled apart or released by a push button, various movable elements within the vehicle are shifted to a new position. Other types of toy vehicles transform into a different shape. In one example, a toy car transforms into a helicopter by extending a top member into a rotor and by pivoting side panels into landing elements. In another example, a toy vehicle which initially appears as a covered car transforms into a convertible when a rotatable roof is flipped over to expose the roof's interior concave surface.

Continuing development of novel features in toy vehicles stimulates new and creative play activities not offered previously in the art.

SUMMARY

The toy vehicle according to the present invention provides features which encourage imaginative play including action play or fantasy play. A toy vehicle according to the present invention has an inner portion which may be slid relative to a main portion of the vehicle to transform the vehicle from a first configuration to a second configuration. The vehicle may include a roof panel which briefly closes an open roof area during the sliding of the inner portion from the main portion of the toy. The closing of the roof area hides the displacement of a first seat in the vehicle by a second seat. When the first seat is mounted with a first toy figure and the second seat is mounted with a different toy figure, an illusion is created that the initial toy figure has changed appearance. Furthermore, the closing and opening of the roof may occur at such a rate that simulates an instantaneous change in the toy figure exposed under the roof area. In one optional embodiment, the sliding maneuver may transform the toy vehicle from a compact configuration to an expanded configuration, thus changing the appearance of the overall toy vehicle. Additional optional movable components such as projectile launchers, tail fins, and front bumpers may be incorporated to be deployed in the expanded state of the vehicle.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENTS

Figure 1:
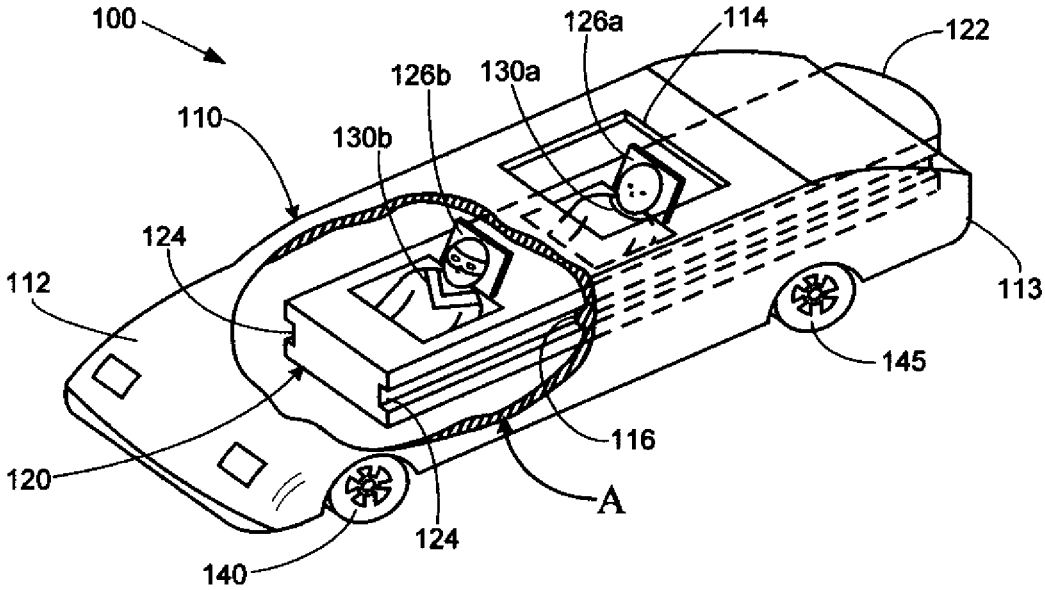
FIG. 1 provides a perspective partial cut-away view of a first toy vehicle embodiment according to the present invention, in a compact configuration.
Figure 2:
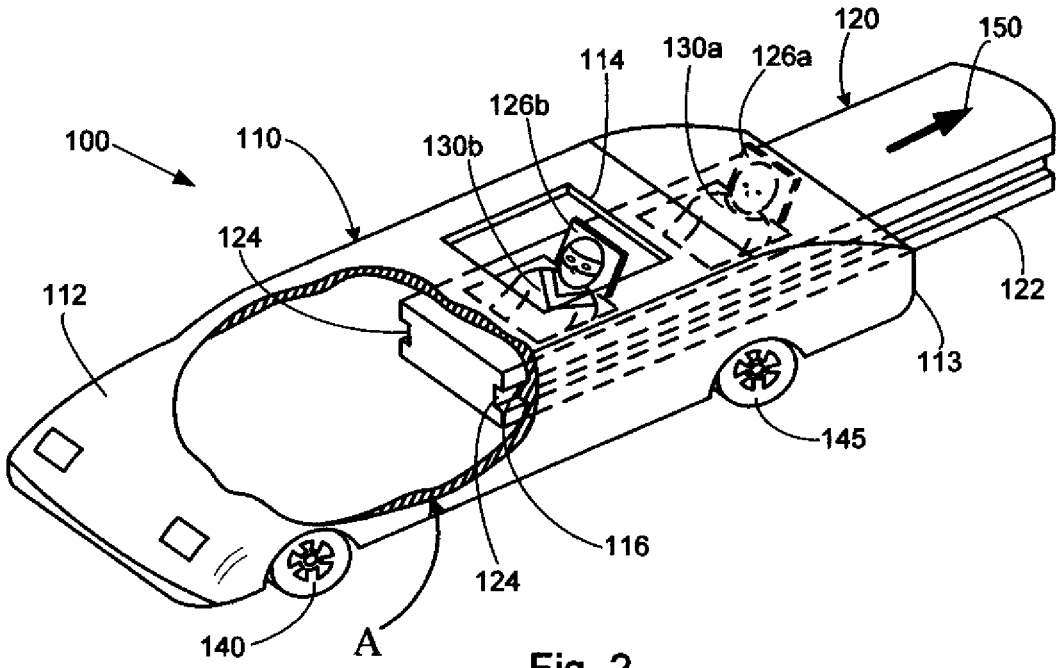
FIG. 2 is a perspective partial cut-away view of the toy vehicle of FIG. 1 in its expanded configuration.

A first embodiment according to the present invention is depicted as a vehicle 100 in FIGS. 1 and 2. Vehicle 100 has a main body 110 which includes a front portion 112, a rear portion 113, a roof opening 114, and a tab 116 running longitudinally along the interior of each side. An inner block 120 inserted within main body 110 includes a rear portion 122, a groove 124 running lengthwise along each side, a first seat 126*a*, and a second seat 126*b* in front of first seat 126*a*. A first toy FIG. 130*a* and a second toy FIG. 130*b* are mounted into first seat 126*a* and second seat 126*b*, respectively, and may be either fixedly attached to inner block 120 or may be removable as play figures. Front wheels 140 and rear wheels 145 are coupled to vehicle 100 to provide mobility. Note that while vehicle 100 is depicted in the form of a car, the vehicle 100 may also take the form of other vehicles such as a truck, a van, an aircraft, or a water vehicle.

FIG. 1 shows vehicle 100 in a compact configuration, in which inner block 120 is substantially housed within main body 110 and only rear portion 122 remains outside vehicle 100. In this compact configuration, first seat 126*a*, and consequently first toy FIG. 130*a*, may be seen through roof opening 114. Second seat 126*b* and second toy FIG. 130*b* are hidden from view under front portion 112 of vehicle 100. A cut-out section "A" in FIG. 1 demonstrates how second toy FIG. 130*b* and second seat 126*b* are located in their hidden positions.

Vehicle 100 is capable of transforming from the compact configuration of FIG. 1 to an expanded configuration as shown in FIG. 2. This transformation is achieved by a user manually sliding inner block 120 out of main body 110 as indicated by directional arrow 150 in FIG. 2. When vehicle 100 transforms to its expanded configuration, second seat 126*b*, illustrated here as holding second toy FIG. 130*b*, becomes exposed through roof opening 114. Consequently, first seat 126*a* and first toy FIG. 130*a* become hidden from view under the rear portion 113 of main body 110 as represented by broken lines for illustrative purposes. This process can be reversed by sliding inner block 120 back into main body 110 in the opposite direction of arrow 150 to achieve the compact configuration of FIG. 1. This exchangeable seating feature of alternately exposing seats allows a user to pretend that a toy figure within the vehicle 100 has changed appearance. For example, the user may pretend that a toy figure is changing from a plain-clothes person to a superhero alter-ego. Alternatively, the change in appearance can represent a fantasy time exchange by showing a figure changing from young to old, or from wearing fashions from one era to another.

Although FIG. 1 and FIG. 2 depict a sliding mechanism provided by groove 124 and tab 116, other methods can be utilized for providing the relative movement between main body 110 and inner block 120. Some examples include a linear slide, a crank coupled to a gear system, or a spring release mechanism to eject inner block 120 from main body 110. Note that vehicle 100 may be configured to allow inner block 120 to be fully removed from main body 110 or may include stops to limit the forward and backward travel of inner block 120. Furthermore, main body 110 and inner block 120 may be configured to move rotationally relative to each other, for example as concentric cylinders, rather than linearly.

A further embodiment according to the present invention shall be described in connection with FIGS. 3 and 4. This further embodiment employs the exchangeable seating feature described with respect to vehicle 100 as well as additional deployable elements. In the perspective view of FIG. 3, a vehicle 200 is in a compact configuration and has a main body 210 which includes a front section 212 and a roof opening 214. Vehicle 200 also includes a first seat 220*a*, a first toy FIG. 230*a* seated in seat 220*a*, front wheels 240, rear wheels 245, two front bumper sections 250, and side panels 260. A slidable rear portion 270 of vehicle 200 has a tail spoiler 272 and two rear quarter panels 274 coupled to it.

Figure 3:
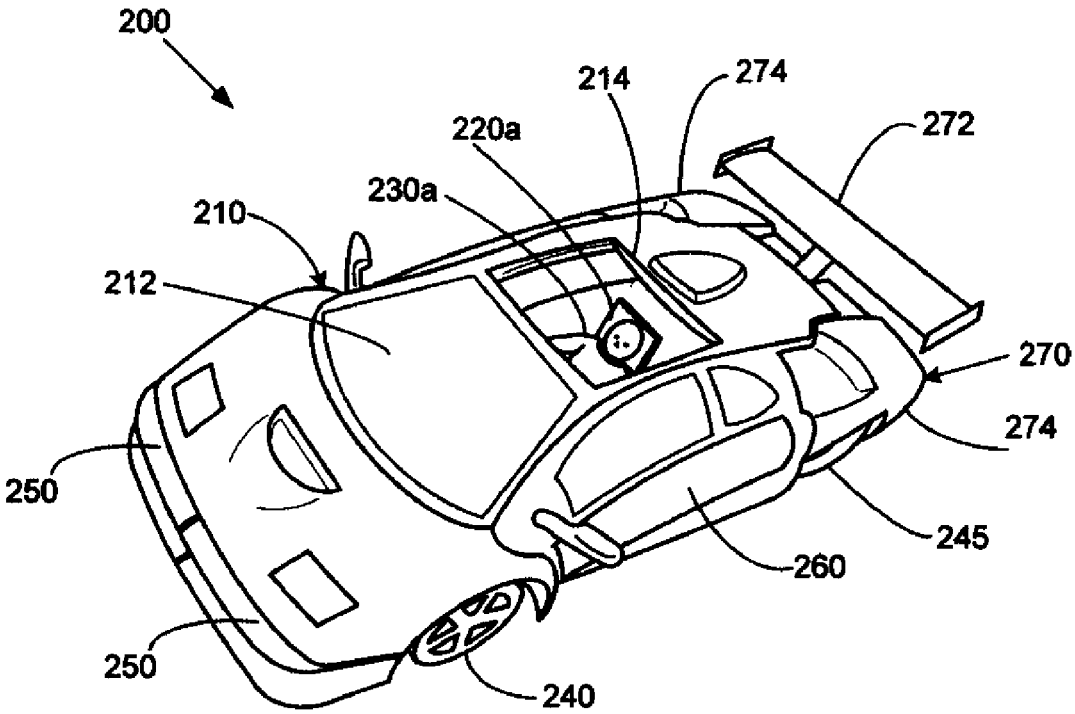
FIG. 3 shows a perspective view of a further embodiment of a vehicle according to the present invention, in a compact configuration.

In this compact configuration of FIG. 3, front wheels 240, front bumper sections 250, and rear portion 270 are substantially adjacent to main body 210. Side panels 260 are folded against the sides of main body 210, and rear quarter panels 274 with the attached rear wheels 245 are substantially adjacent to rear portion 270. Furthermore, first toy FIG. 230*a* and first seat 220*a* are exposed and visible through roof opening 214.

Figure 4:
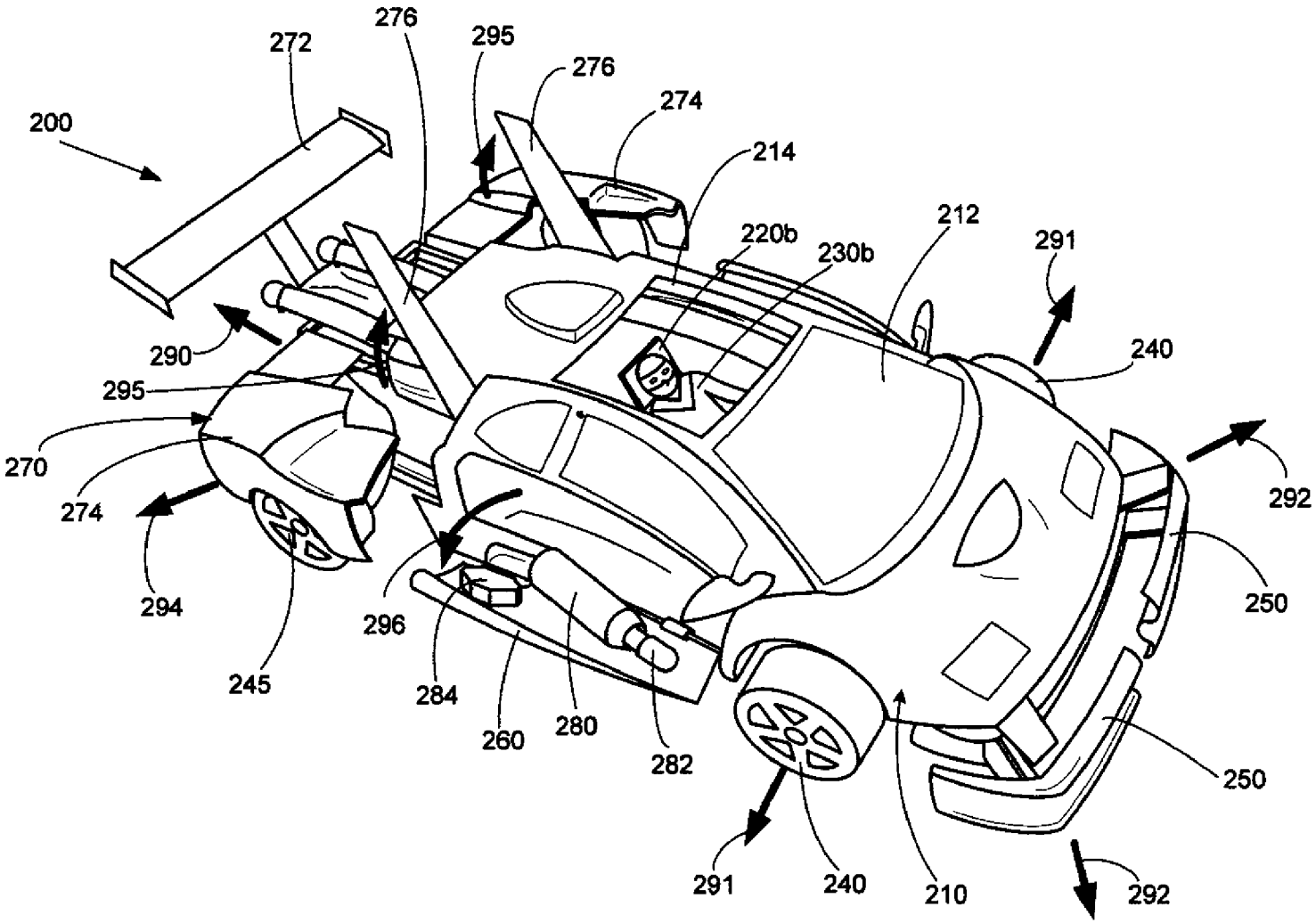
FIG. 4 is a perspective view of the embodiment of FIG. 3 in its expanded configuration.

FIG. 4 reveals the vehicle 200 of FIG. 3 in an expanded configuration. In this expanded configuration, stabilizer fins 276, a projectile launcher 280, a projectile 282 mounted in projectile launcher 280, a trigger button 284, a second seat 220*b*, and a second toy FIG. 230*b* are introduced. The user achieves this expanded configuration of FIG. 4 by grasping tail spoiler 272 and sliding rear portion 270 apart from main body 210 in the direction indicated by arrow 290. Sliding the rear portion 270 apart from main body 210 results in the same exchangeable seating feature described for vehicle 100 of FIG. 2. That is, second seat 220*b* and second toy FIG. 230*b*, which were hidden under front section 212 in the compact configuration of FIG. 3, are shifted rearward to be exposed through roof opening 214.

In addition to the seating exchange, the movement of rear portion 270 to the expanded configuration of vehicle 200 in FIG. 4 also actuates deployment of other components. Front wheels 240 are extended outward beyond the sides of main body 210 as shown by arrow 291, front bumper sections 250 are extended diagonally outward from main body 210 as shown by arrows 292, tail spoiler 272 is moved rearward as shown by arrow 290, and rear quarter panels 274, to which rear wheels 245 are coupled, are extended diagonally outward from rear portion 290 as shown by arrow 294. The displacement of rear quarter panels 274 provides space for stabilizer fins 276, which are stored within vehicle 200 in its compact configuration, to be upwardly deployed from the back of main body 210 as shown by arrows 295. Lastly, the expanded configuration of vehicle 200 results in side panels 260 being pivoted outward as shown by arrow 296, thereby revealing a projectile launcher 280 within each side panel 260 on each side of vehicle 200. Projectile launcher 280 may be loaded with a projectile 282, which is launched by pressing trigger button 284 via any appropriate spring mechanism known in the art. The deployable components of FIG. 4 are merely exemplary, as other features with various actuations are possible. Deployment of the components of FIG. 4 may be achieved by, for example, springs, gears, levers, and other means known in the art.

Figure 5A:
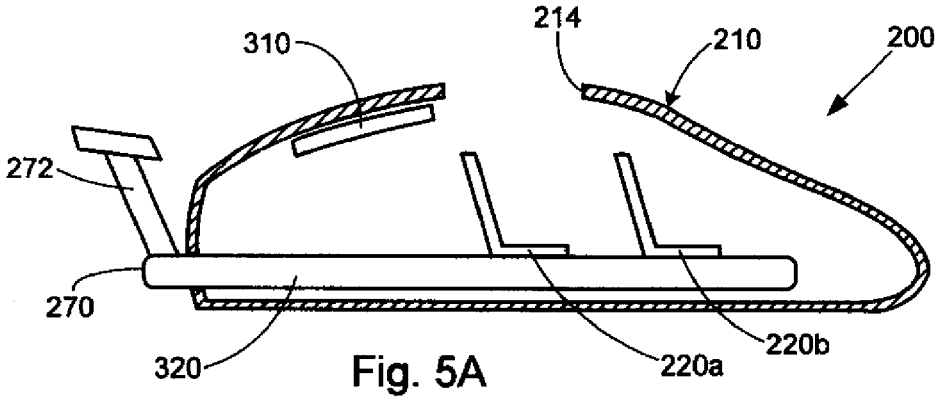
FIGS. 5A, 5B, and 5C are schematic cross-sectional views of the movement of a roof panel.
Figure 5B:
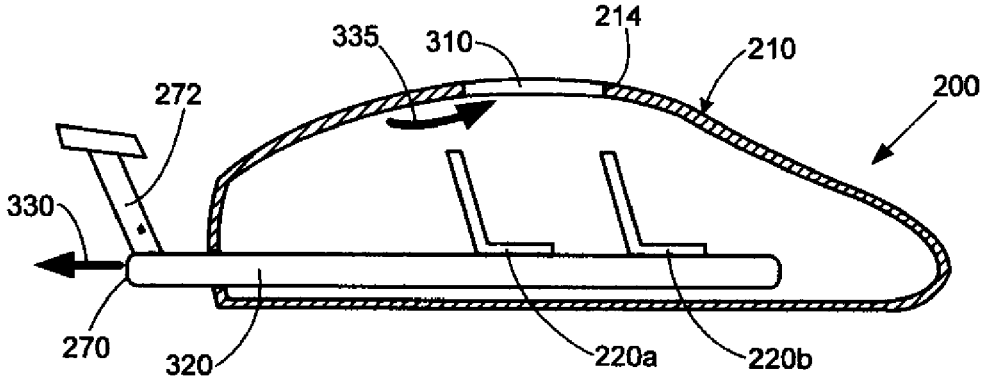
Figure 5C:
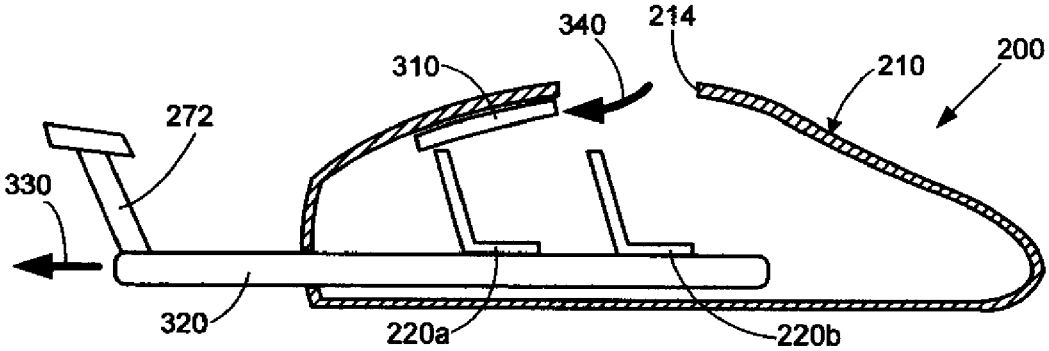

The side cross-sectional schematic views of FIGS. 5A, 5B, and 5C reveal a movable roof feature of vehicle 200, involving a roof panel which changes position while vehicle 200 transitions from its compact configuration to its expanded configuration. In these cross-sectional views taken down a longitudinal center line of vehicle 200, an opaque roof panel 310 and an inner block 320 are viewed within main body 210. Inner block 320, which is shown in FIGS. 5A, 5B and 5C, provides an exchangeable seating feature similar to inner block 120 of FIG. 1. Tail fin 272 of FIGS. 5A, 5B and 5C, is integral to inner block 320 such that when the user grasps and pulls tail fin 272, inner block 320 is slid rearward. This sliding action results in second seat 220*b* being positioned under roof opening 214 in place of first seat 220*a*.

FIG. 5A shows vehicle 200 in its compact configuration, in which first seat 220*a* is exposed through roof opening 214 and inner block 320 is fully compacted within vehicle 200. In this embodiment, roof panel 310 is stored rearward of roof opening 214 and within main body 210. In FIG. 5B, as the user pulls rear portion 270 in the direction of arrow 330 to transition vehicle 200 from its compact configuration to its expanded configuration, roof panel 310 moves according to arrow 335 to cover roof opening 214. Therefore, roof opening 214 is closed while first seat 220*a* is replaced by second seat 220*b*. When vehicle 200 reaches its fully expanded configuration as shown in FIG. 5C, roof panel 310 slides out of roof opening 214 and back to its stored position as indicated by arrow 340. In the expanded configuration, the roof opening 214 is open to reveal second seat 220*b*, which is typically holding a different toy figure than that of first seat 220*a*. Thus, an illusion is created that the initial toy figure has changed appearance. The movement of roof panel 310 into and out of roof opening 214 is desirably a rapid movement to provide an impression of an instantaneous change between seats 220*a* and 220*b*, although of sufficient time to hide the exchange of seats.

Figure 6:
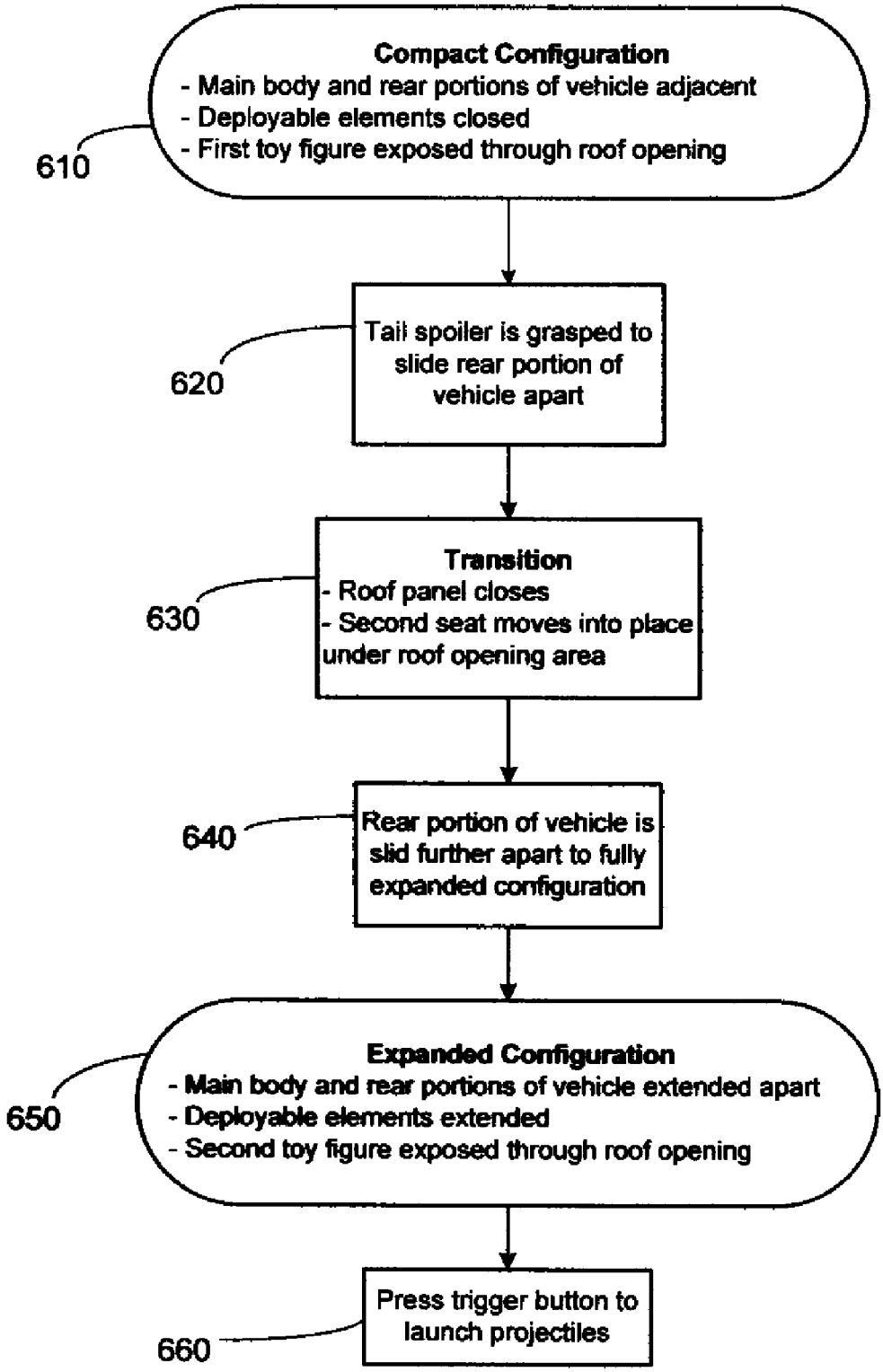
FIG. 6 illustrates a process flowchart describing the steps for transitioning the exemplary toy vehicle from its compact configuration of FIG. 3 to its expanded configuration of FIG. 4.

The process flowchart pictured in FIG. 6 shows the operation of toy vehicle 200 changing from its compact configuration of FIG. 3 to its expanded configuration of FIG. 4. Step 610 represents the compact configuration of the toy vehicle, wherein the main body and rear portion of the vehicle are adjacent. Deployable elements, such as the front wheels, front bumper sections, side panels, tail spoiler, and rear quarter panels are all substantially adjacent to the main body of the vehicle. In addition, the stabilizer fins are within the toy vehicle. In this compact configuration, the first toy figure is exposed through the roof opening. Step 620 indicates that the tail spoiler of the vehicle is then grasped to slide the rear portion of the vehicle apart from the main body. As indicated in step 630, this sliding action causes the roof panel to close so that the roof opening area is hidden while the first seat is displaced by the second seat within the toy vehicle. Step 640 indicates that sliding the rear portion of the vehicle further apart results in a fully expanded configuration of the toy vehicle. As represented in step 650, in the expanded configuration, the deployable elements are all extended from the toy vehicle. Also, the side panels are pivoted outward from sides of the toy vehicle to expose the enclosed projectile launchers. The projectile launchers may then be fired by pressing the trigger button, as noted in step 660.

Figure 7A:
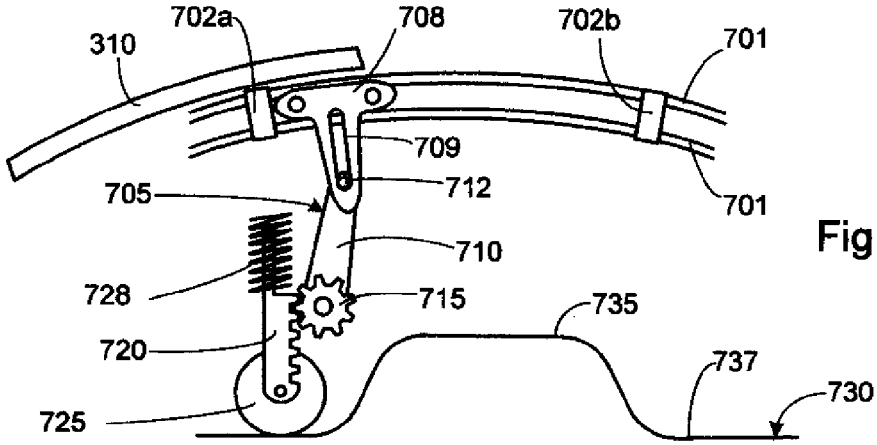
FIGS. 7A, 7B, and 7C are schematic diagrams of an exemplary mechanism for moving the roof panel of the toy vehicle of FIGS. 5A, 5B, and 5C.
Figure 7B:
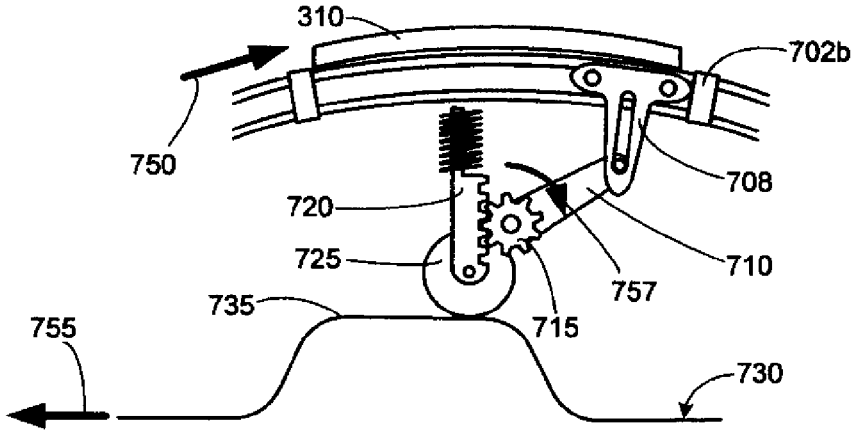
Figure 7C:
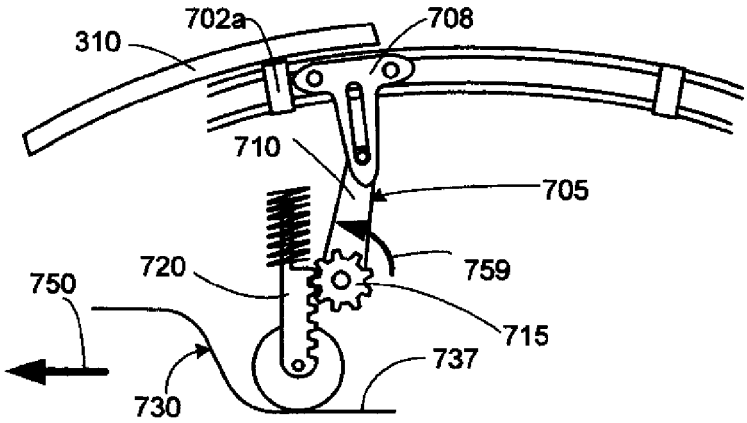

FIGS. 7A, 7B, and 7C provide schematic diagrams of an exemplary means for closing the roof opening 214 with roof panel 310 during the transition of the toy vehicle 200 from its compact configuration to its expanded configuration as depicted in FIGS. 5A, 5B, and 5C. In the embodiment of FIGS. 7A, 7B, and 7C, guide rails 701 mounted with a first stop 702*a* and a second stop 702*b* are shown. A slider assembly 705 includes a slider 708 sliding within guide rails 701, a slot 709 within slider 708, an arm 710 with an arm pin 712 and a gear 715 fixedly attached, a rack 720 mating with gear 715, a roller 725 rotatably coupled to rack 720, and a spring 728 on rack 720. Arm pin 712 couples arm 710 to slider 708 through slot 709. Slider assembly 705 is constrained between guide rails 701 and surface 730. Surface 730 has a ramp 735 and a lower plane 737 on either side of ramp 735. Surface 730 is attached to inner block 320 of FIGS. 5A-5C, and thus moves correspondingly with any movement of inner block 320. Roof panel 310 is attached to slider 708 with means, not shown, such as adhesives, screws, snap-fit tabs, or the like.

FIG. 7A represents the vehicle 200 in its compact configuration, such that roof panel 310 is hidden under the rear portion of vehicle 200. The distance between first stop 702*a* and second stop 702*b* represents the area for roof opening 214, which is essentially uncovered by roof panel 310 in this compact configuration. Rack 720 is pushed downward by spring 728 such that roller 725 maintains contact with surface 730. Note that spring 728 is shown as a compression spring, but may also be a torsion spring or other elastic member known in the art. Gear 715 mates with rack 720, and is fixed to arm 710 such that arm 710 rotates with gear 715.

During the transition period between the compact configuration and the expanded configuration, as represented by FIG. 7B, roof panel 310 slides over to close the roof opening 214 as shown by arrow 750. This roof movement is initiated when the user begins pulling surface 730, connected to inner block 320 of FIG. 5, in the direction shown by arrow 755. As surface 730 moves, roller 725 travels up ramp 735, thus moving rack 720 vertically upward as well. The vertical movement of rack 720 causes gear 715 and mating arm 710 to rotate as indicated by directional arrow 757, thus pushing slider 708 toward second stop 702*b*. Additional horizontal spring elements, not shown, may be coupled to slider assembly 705 to increase the horizontal distance moved by slider assembly 705 and to cause roof panel 310 to open and close with a more rapid movement. In particular, two opposing springs may provide one force for the roof-opening movement and an opposing force for the roof-closing movement. Horizontal spring elements could be, for example, coupled to slider 708 along guide rails 701 or coupled to rack 720.

When the user pulls surface 730 to its fully expanded configuration of FIG. 7C, the ramp 735 is no longer in range of slider assembly 705. Consequently, roller 725 follows surface 730 to its lower plane 737, rack 720 is lowered, and gear 715 rotates arm 710 clockwise as shown directionally by arrow 759. As a result, slider 708, with roof 310 attached, is moved back to its open position at first stop 702*a*. The previously mentioned horizontal spring elements, not shown, assist in translating slider assembly 705 back to its original position such that roof panel 310 uncovers the roof opening area 214 of vehicle 200.

Figure 8A:
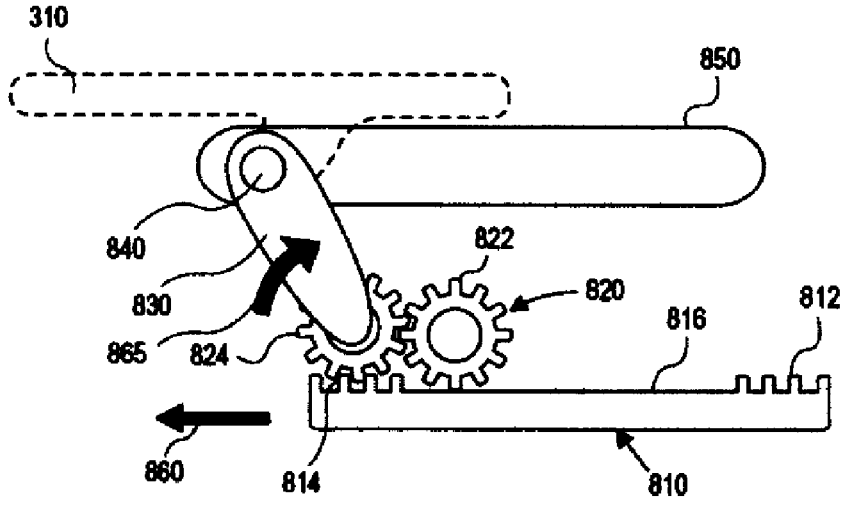
FIGS. 8A, 8B, and 8C are schematic diagrams of a further embodiment of a mechanism for moving the roof panel of the toy vehicle of FIGS. 5A, 5B, and 5C.
Figure 8B:
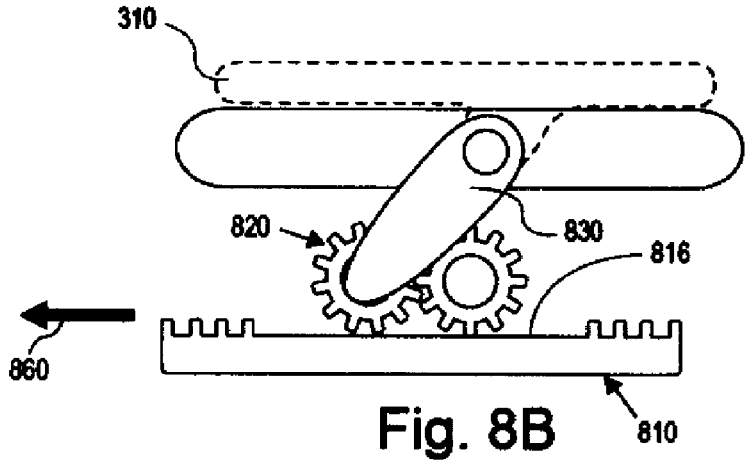
Figure 8C:
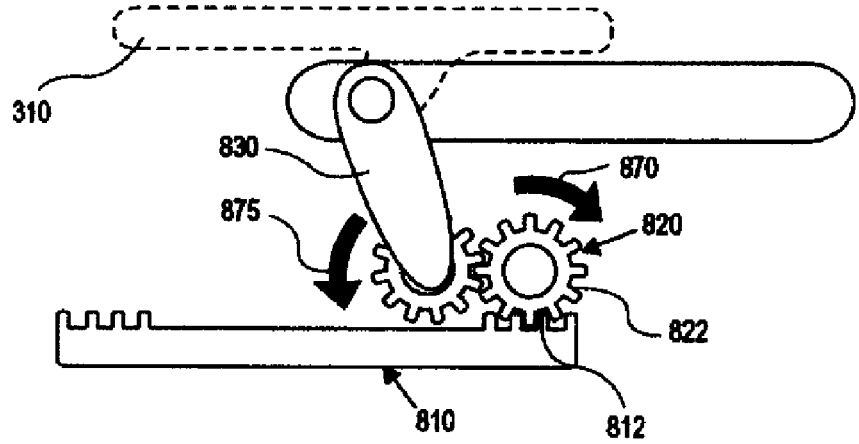

An alternative embodiment configuration for moving roof panel 310 is shown in FIGS. 8A, 8B, and 8C. In this embodiment, a toothed slider 810 has a first set of gear teeth 812 at one end, a second set of gear teeth 814 at the opposite end, and a flat section 816 in between. Toothed slider 810 is coupled to and moves in concert with the previously described inner block 320. Toothed slider 810 engages a gear set 820, which in this embodiment includes a front gear 822 and a crank gear 824. Crank arm 830 is fixedly attached to crank gear 824, which slides a pin 840 in a slot 850 as crank arm 830 is rotated. Roof panel 310 is consequently opened and closed with crank arm 830.

FIG. 8A depicts the compact configuration of the toy vehicle of the present invention. Toothed slider 810 is fully forward, corresponding to compacted configuration of inner block 320. In this position, crank arm 830 is in a backwardly rotated position (angled to the left in the figure). As the vehicle is transitioned toward an expanded configuration as indicated by arrow 860, gear teeth 814 rotate crank gear 824 clockwise as shown by arrow 865, which thus moves roof panel 310 towards a closed position. Roof panel 310 is fully closed in FIG. 8B, which represents the transitional state in which the aforementioned first and second seats are exchanged. During this transitional state of FIG. 8B, the flat section 816 of toothed slider 810 ceases movement of gear set 820, and the roof panel 310 remains closed. The vehicle reaches its fully expanded configuration in FIG. 8C, where the final movement of toothed slider 810 causes gear teeth 812 to encounter and rotate gear set 820 by engaging front gear 822. Front gear 822 is rotated clockwise (arrow 870), which causes crank gear 824 and crank arm 830 to rotate counterclockwise (arrow 875). As a result, roof panel 310 is reopened and the second seat (not shown) is revealed. In FIGS. 8A-8C, the length of the flat section 816 and the ratio of the gear set 824 may be designed to invoke a rapid opening and closing of roof panel 310.

While FIGS. 7A-7C and 8A-8C depict two methods for moving roof panel 310, other methods are possible. For instance, instead of having roof panel 310 stored rearward of roof opening 214 during both the compact and expanded configurations, roof panel 310 may instead be stored under the front portion 212 of main body 210 in the compact configuration and then moves rearward of roof opening 214 in the expanded configuration. In another example, the slider 708 of FIGS. 7A-C may be replaced by a bell crank, and slider assembly 705 may be configured with various combinations of levers, springs, gears, and the like to provide the opening and closing action of roof panel 310. In FIGS. 8A-8C, additional gears may be incorporated, and springs may be used to augment the rate at which roof panel 310 opens and closes.

Although specific embodiments according to the present invention have been described, other variations are possible. For instance, the inner block which has been described as being configured with two seats may instead have more than two seats in keeping with the teachings of the present invention. Moreover, the single inner block may be replaced by separate inner blocks, each having a seat, which are connected to each other and consequently move together. In another embodiment, the linear relative movement of the main body of the vehicle and an inner block may be replaced by, for instance, a rotational movement between a main body and an auxiliary portion. In such a rotational configuration, toothed slider 810 may be replaced by other types of actuators, such as a cam or other gears.

In another variation, objects other than seats mounted with toy figures may be presented as changing appearance. As an example, a control panel viewed through the roof opening of an aircraft vehicle may change from a passenger aircraft control panel to a military control panel. In another example, a seating area within a limousine vehicle may change from a single seat to a double seat. Furthermore, the roof opening according to the present invention may be configured as an opening over another area of the vehicle, such as a trunk space which may initially appear empty but then reappear as full.

In a further variation, the vehicle according to the present invention may have initial and final states other than an initial compact configuration and a final expanded configuration. For instance, a vehicle may have an elongated configuration which serves as the initial state and a final shorter configuration in which various components are deployed. Alternatively, a vehicle may have a first configuration in which a first set of components are protruded from the vehicle, and a second configuration in which the first set of components are retracted while a second set of components are deployed. Other variations are possible in which the movable components of the vehicle are operable to move between a first position and a second position.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention.

What is claimed is:

1. A toy vehicle comprising:

a main body having a front portion and a roof opening;

a movable roof panel coupled to the main body, wherein the roof panel moves between an open position exposing the roof opening and a closed position covering the roof opening;

an inner block coupled to the main body, wherein a portion of the inner block slides out of the main body to transition the toy vehicle from a compact configuration to an expanded configuration, and wherein the inner block is configured with a first seat and a second seat; and wherein the first seat is exposed through the roof opening when the toy vehicle is in the compact configuration, and wherein the second seat is exposed through the roof opening when the toy vehicle is in the expanded configuration.

2. The toy vehicle of claim 1, wherein the first seat is capable of supporting a first toy figure and the second seat is capable of supporting a second toy figure, and wherein the movable roof panel moves to the closed position during the transition from the compact configuration to the expanded configuration.

3. The toy vehicle of claim 1, wherein the movable roof panel is in the open position when the toy vehicle is in the compact configuration, is in the closed position while the toy vehicle transitions between the compact configuration and the expanded configuration, and is in the open position when the toy vehicle is in the expanded configuration.

4. The toy vehicle of claim 3, wherein the movable roof panel moves from the open position to the closed position and back to the open position at a rate which substantially creates an illusion of an instantaneous transformation from the first seat to the second seat being exposed through the roof opening.

5. The toy vehicle of claim 3, further comprising:

a gear set;

a crank arm coupled to the gear set, wherein the crank arm is coupled to the movable roof panel;

a slider coupled to the inner block, wherein the slider has first gear teeth at a first end of the slider, second gear teeth at a second end of the slider, and a flat section between the first gear teeth and the second gear teeth; and wherein the first gear teeth and the second gear teeth engage the gear set to move the movable roof panel.

6. The toy vehicle of claim 1, further comprising deployable components mounted to the toy vehicle, wherein the deployable components are retracted when the toy vehicle is in the compact configuration, and wherein the components are deployed when the toy vehicle is in the expanded configuration.

7. The toy vehicle of claim 6, further comprising toy projectile launchers mounted to at least one of the deployable components on the toy vehicle.

8. The toy vehicle of claim 6, wherein the toy vehicle is at least one of a car, a truck, a van, an aircraft and a water vehicle.

9. A toy vehicle comprising:

a main body having a roof opening;

an auxiliary body portion movably coupled to the main body, wherein the auxiliary body portion transitions from a compact first position to an expanded second position with respect to the main body;

a movable roof panel mounted coupled to the main body, wherein the movable roof panel moves between an open position exposing the roof opening and a closed position covering the roof opening; and wherein the movable roof panel is in the open position when the auxiliary body portion is in the first position, is moved to a closed position during the transition from the first position to the second position, and is in the open position when the auxiliary body portion is in the second position.

10. The toy vehicle of claim 9, wherein the roof opening comprises a groove, and wherein the movable roof panel slides within the groove.

11. The toy vehicle of claim 9, further comprising:

a gear set;

a crank arm coupled to the gear set, wherein the crank arm is coupled to the movable roof panel;

an actuator coupled to the auxiliary body portion, wherein the actuator has first gear teeth at a first end of the actuator, second gear teeth at a second end of the actuator. and a flat section between the first gear teeth and the second gear teeth; and wherein the first gear teeth and the second gear teeth engage the gear set to move the movable roof panel.

12. The toy vehicle of claim 9, wherein the movable roof panel moves from the first position to the second position and back to the first position at a rate which substantially creates an illusion of instantaneously covering the roof opening.

13. A method of constructing a toy vehicle, wherein the toy vehicle includes a main body with a roof opening, an auxiliary body portion, a roof panel, a first seat and a second seat, the steps comprising:

coupling the auxiliary body portion to the main body, wherein the auxiliary body portion moves from a first position to a second position with respect to the main body to transition the toy vehicle from a compact first configuration to an expanded second configuration;

configuring the roof panel to move into and out of the roof opening during the transition from the first configuration to the second configuration;

supplying a means for coupling movement of the auxiliary body portion to movement of the roof panel; and positioning the first seat and the second seat on the auxiliary body portion so that the first seat appears through the roof opening when the toy vehicle is in the first configuration and the second seat appears through the roof section when the toy vehicle is in the second configuration.

14. The method of constructing a toy vehicle of claim 13, wherein the step of coupling comprises a sliding relationship between the auxiliary body portion and the main body.

15. The method of constructing a toy vehicle of claim 13, wherein the step of supplying comprises supplying a gear set and an actuator having first gear teeth at a first end of the actuator and second gear teeth at a second end of the actuator, wherein the gear set is engaged by the actuator.

16. The method of constructing a toy vehicle of claim 13, further comprising the step of installing deployable components, wherein the deployable components are deployed when the auxiliary body portion is moved from the first configuration to the second configuration.

17. The method of constructing a toy vehicle of claim 16, wherein the deployable components are at least one of (i) side panels mounted to the main body, (ii) side vertical stabilizer fins mounted to the auxiliary body portion, (iii) bumper sections mounted to the main body, and (iv) rear quarter panels mounted to the auxiliary body portion.

18. The method of constructing a toy vehicle of claim 17, wherein the toy vehicle further includes toy projectile launchers mounted to at least one of the deployable components.

19. The method of constructing a toy vehicle of claim 13, wherein the toy vehicle is at least one of a car, a truck, a van, an aircraft and a water vehicle.

* * * * *